US005188343A

United States Patent [19]

Galea

[11] Patent Number: 5,188,343

[45] Date of Patent: Feb. 23, 1993

[54] SPRING SYSTEM FOR UPHOLSTERED FURNITURE

[75] Inventor: Joseph M. Galea, Seagrave, Canada

[73] Assignee: Sklar-Peppler Furniture Corporation, Whitby, Canada

[21] Appl. No.: 705,604

[22] Filed: May 24, 1991

[30] Foreign Application Priority Data

Apr. 30, 1991 [CA] Canada ..... 2041488

[51] Int. Cl.[5] ..... A47C 23/00

[52] U.S. Cl. ..... 267/103; 5/253; 5/255

[58] Field of Search ..... 267/81, 87, 90, 98-103, 267/105, 106; 5/247, 252, 253, 255

[56] References Cited

U.S. PATENT DOCUMENTS

| | | | |
|---|---|---|---|
| 2,234,253 | 3/1941 | Hopkes | 267/87 |
| 2,280,912 | 4/1942 | Hopkes | 267/87 |
| 2,305,530 | 12/1942 | Hopkes | 267/102 |
| 2,439,789 | 4/1948 | Bank | 5/255 |
| 2,675,065 | 4/1954 | Keller | 267/87 |
| 2,787,317 | 4/1957 | Vogel | 267/102 |
| 3,248,745 | 5/1966 | Gunlock | 267/105 |
| 3,560,049 | 2/1971 | Burton | 5/255 |
| 4,805,883 | 2/1989 | Kitchen | 267/105 |
| 4,819,920 | 4/1989 | Barber | 267/90 |
| 4,886,250 | 12/1989 | Lucas | 267/103 |

FOREIGN PATENT DOCUMENTS 972085 7/1975 Canada .

1217579 2/1987 Canada .

*Primary Examiner*—Robert J. Oberleitner
*Assistant Examiner*—Chris Schwartz
*Attorney, Agent, or Firm*—Smart & Biggar

[57] ABSTRACT

The present invention relates to a spring assembly for the seat portions or areas of upholstered furniture. The spring assembly provides a frame and a series of different spring types supported in a generally parallel arrangement within the frame. The spring assembly inlcudes a plurality of upper spaced, elongate sinuous springs extending between and above a pair of opposing front and back members. Located in the central region of the assembly is a rectangular quad coil spring mounted on two upper and lower wire stringers. The spring assembly is provided with a pair of Z-shaped sinuous springs, one located on each lateral side of the quad coil. The Z-shaped springs are mounted on lower elongate sinuous springs extending between the front and back members. The upper portions of the Z-shaped sinuous springs and the upper elongated sinuous springs are secured to the upper and lower stringers for stability and to prevent lateral movement of same. The Z-shaped springs provide for local support independent of the central quad coil. The spring assembly provides a differential response across the top surface thereof in response to a user sitting thereon. When several such assemblies are mounted adjacent one another, the resulting system provides for relative independent spring support between adjacent users.

6 Claims, 7 Drawing Sheets

SPRING SYSTEM FOR UPHOLSTERED FURNITURE

The present invention relates to a spring assembly for the seat portions or areas of upholstered furniture such as chairs, loveseats and sofas. In particular, the invention relates to an improved spring assembly and system which is better able to accommodate the loads typically applied to the seat portions of upholstered furniture.

PRIOR ART

Prior art spring assemblies for the seat portions of upholstered furniture such as loveseats or sofas have traditionally been integral units very basic in design and spanning the length of the seating area of the furniture. The main disadvantage of such prior art spring assembly systems is that a downward pressure exerted by a person sitting at one end of a piece of upholstered furniture with multiple seating areas, such as a sofa will result in sagging in adjacent areas in view of the spring system being integral or interconnected. Consequently, a person of a heavy weight sitting on a sofa next to a person of a lighter weight will result in the person of a lighter weight assuming an uncomfortable sitting position, being slightly tilted towards the person of heavy weight.

Recently, upholstered furniture having multiple seating areas has been made available wherein each seating area has its own spring assembly which may function independently of spring assemblies in adjacent areas. Reference may be made to Canadian patent No. 1,217,579 issued Feb. 3, 1987 to Sklar-Peppler Inc., a predecessor of the applicant herein. Although an improvement, such adjacent spring assemblies still suffer from disadvantages inherent to the type of spring assembly employed.

A further disadvantage inherent in prior art spring assemblies including those which are independent of each other in multiple seating units, relates to the tendency of loads to shift towards the side of the seating area, i.e., the arm rest, of the upholstered furniture. This arises due to the spring assembly terminating near the ends of the seating areas, for example adjacent each arm rest portion of the upholstered furniture, so that a person sitting adjacent an arm rest will experience a tendency to lean towards the arm. This disadvantage has been addressed to a limited extent in some prior art spring assemblies by placing extra support adjacent the arm rests. In such prior art spring assemblies some extra support has been achieved by placing an additional elongated sinuous spring wire immediately adjacent to the elongated sinuous spring wires located at each end of prior art integral spring assemblies. Although such additional support has helped, the shifting of load towards arm rests remains a problem.

Yet another disadvantage inherent in prior art spring systems for upholstered furniture relates to the uniform tension and support generally present throughout the length of the spring assembly which does not assist to maintain in position a person sitting on such furniture, upon the application of shifting loads. Such prior art spring systems and assemblies also "bottom out" when a very heavy load is applied and are prone to softening with years of usage.

Accordingly, it is an object of the present invention to overcome the difficulties and disadvantages resulting from the application of heavy or shifting loads to various areas of prior art spring assemblies when located under the seating areas of upholstered furniture, particularly chairs, loveseats and sofas.

It is a specific object of the present invention to provide an improved spring assembly which provides for better support adjacent the arm rests or generally near the sides of the spring assembly so as to minimize the effect of shifting loads applied to that area of the seat area.

It is a further specific object of the present invention to provide an improved spring assembly which can offer firmer support generally within each seating area and in addition provide a more stabilized seating capability.

It is yet a further specific object of the present invention to provide an improved spring assembly and system for multiple seating upholstered furniture which assist in providing firmer lateral support for a person sitting thereon.

It is still a further specific object of the present invention to provide an improved spring assembly which will better cushion and accommodate the application of a heavy weight thereto.

SUMMARY OF INVENTION

The present invention provides a spring assembly for the seat portion of upholstered furniture. The assembly has at least one spring sub-assembly which comprises a generally rectangular frame including a back rail, two side rails and a front rail. A plurality of first, upper elongated sinuous wire springs are arranged generally parallel to one another and transversely bridge in a uniform manner the back rail and the front rail at a height above the height of the rails so as to provide a spring effect when a downward pressure is applied thereto. The sub-assembly includes quad-shaped spring means located centrally within the spring assembly which provides general support in the central area of the spring assembly. Also provided is Z-shaped spring means located centrally between the back and front rails on each side of the quad-shaped spring means between the quad-shaped spring means and the side rails for providing local support in the spring sub-assembly between the quad-shaped spring means and each side rail. The sub-assembly includes means for supporting the Z-shaped spring means within the spring sub-assembly. The sub-assembly further comprises upper stabilizing means interconnecting each of the plurality of first, upper elongated sinuous wire springs with one another and with the quad-shaped and the z-shaped spring means. Included is a lower stabilizing means supporting the quad-shaped spring means which interconnects the quad-shaped spring means with the means for supporting the Z-shaped spring means.

In another aspect of the invention there is provided a spring assembly for the seat portion of upholstered furniture. The assembly has at least one spring sub-assembly comprising a frame having a front and back rails, and side rails. Provided is a series of interconnected springs substantially independently supported with the frame. The series of interconnected springs comprise at least three different types of springs including a plurality of upper elongated sinuous wire springs arranged generally parallel to one another and transversely bridging in a uniform manner the front and back rails, quad-shaped spring means located centrally within the spring assembly, the Z-shaped spring means located centrally between the front and back rails on each side of the quad-shaped spring means between the quad-shaped spring means and the side rails. Each of the spring types are capable of exerting a different level of firmness and each are sequentially engaged in order of increasing firmness in response to the application of a person's weight to provide local support for a user sitting on the spring assembly between the Z-shaped spring means while substantially isolating the user from users sitting in any adjacent sub-assemblies comprising the spring assembly.

In drawings which illustrate by example embodiments of the invention:

Figure 1:
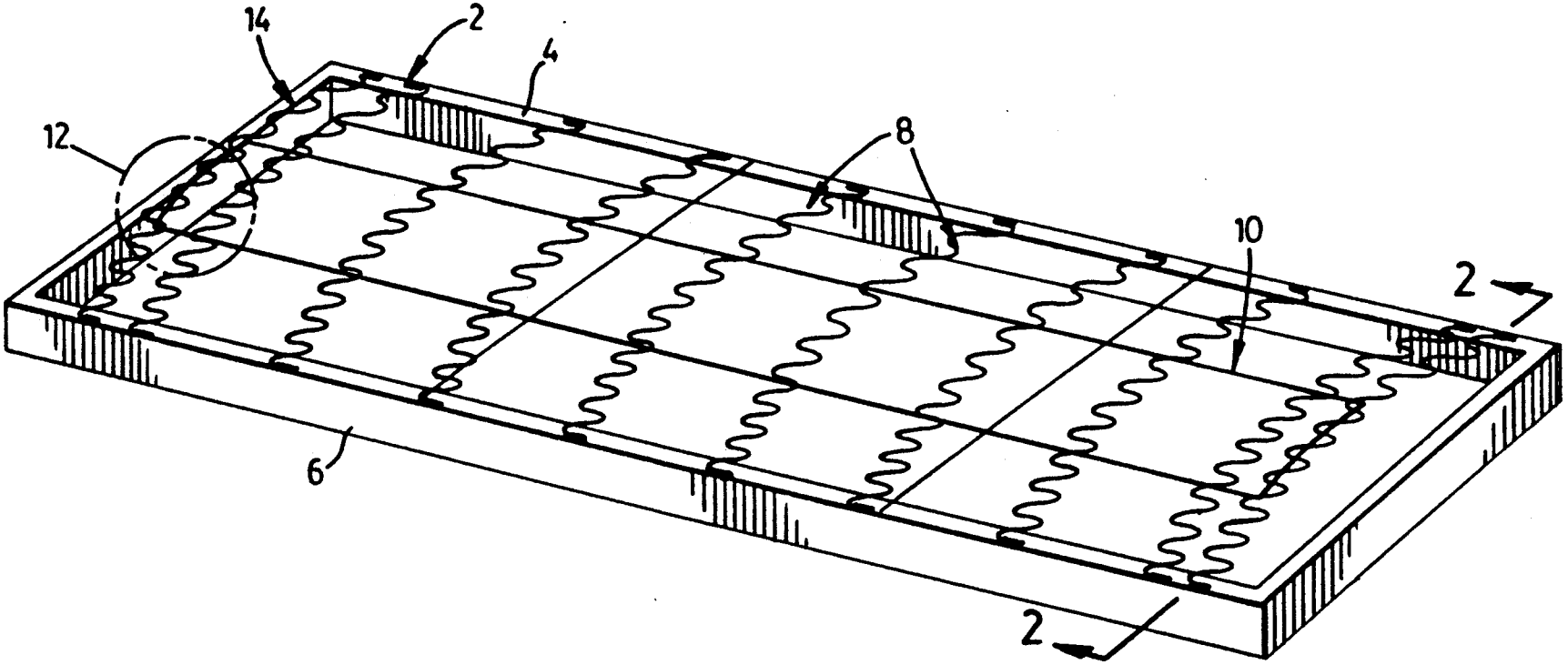
FIG. 1 PRIOR ART
FIG. 1 is a perspective view of a prior art spring assembly for a sofa.

With respect to FIG. 1 of the drawings, a prior art spring assembly will be described. A frame 2 typically made of wood includes a back rail 4 and a front rail 6. Bridging the back rail 4 and front rail 6 is a series of relatively evenly spaced elongated sinuous wire springs 8 which are slightly arched so as to rise above the height of frame 2 in a uniform manner (best seen in FIG. 2). Cushions and decking (not shown) are typically placed on top of the elongated sinuous wire springs 8. Elongated sinuous wire springs 8 are heat tempered so as to provide a spring effect when a load such as a person sitting, is applied thereto. Cross-wires or wire stringers 10 interconnect the elongated sinuous wire springs 8 along the length of the spring assembly by being attached thereto by crimped sleeves, wire clips or the like (not specifically shown in FIG. 1). FIG. 2 shows in cross-section the curvature of elongated sinuous wires 8 as they bridge the back rail 4 and front rail 6. Returning to FIG. 1, the inventor has recognized it is because of the arrangement of wire stringers 10, which serve to try to stabilize the spring assembly as a whole, and the absence of any other support that sagging of the spring assembly occurs in areas adjacent any area where a load such as a person sitting is applied. For example, as previously mentioned, a person of a heavier weight sitting next to a person of a lighter weight on such a prior art spring assembly will result in the person of lighter weight being tilted or forced to lean towards the person of the heavier weight. This can be annoying, for example when the person of lighter weight happens to be holding a glass of wine which may be partially spilled as a result of a person of a heavier weight sitting on the sofa next or near to the person of the lighter weight.

Figure 2:
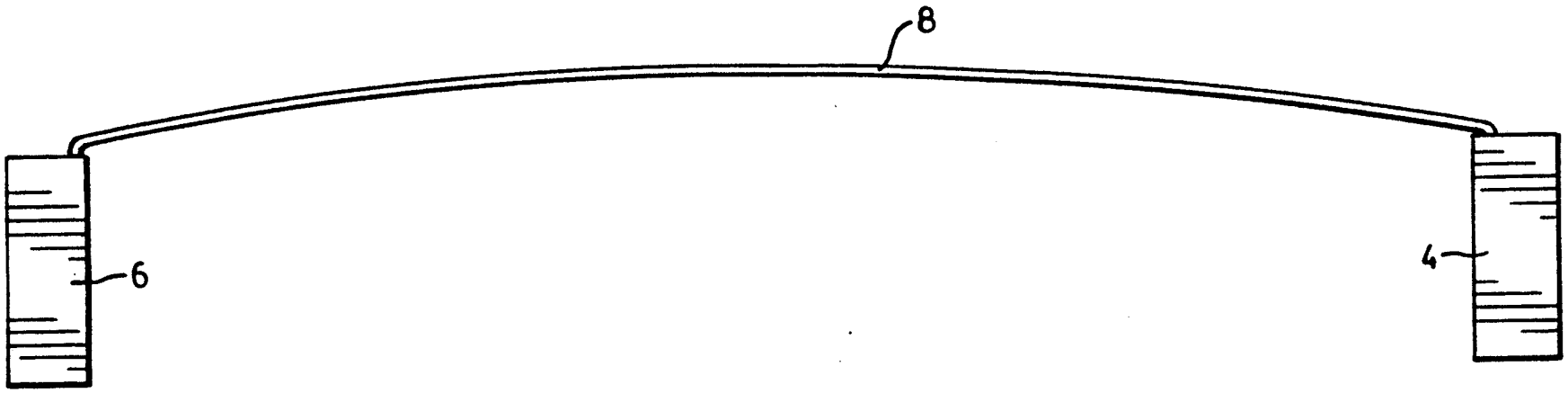
FIG. 2 PRIOR ART
FIG. 2 is a cross-sectional view taken along line $2^1$ of FIG. 1.

Also referring to FIG. 1 by way of example of prior art spring assemblies, it may be noted that a person sitting on the very end of the spring assembly as at 14, will have a tendency to be leaning or shifted towards the arm rest typically located at that side or end of the piece of upholstered furniture. This occurs as a result of the diminished support available within the area of the side or end of the spring assembly. To some extent prior art spring assemblies have tried to address this problem by adding an additional elongated sinuous wire spring near the end of the spring assembly as may be seen in area 12 of the prior art spring assembly illustrated in FIG. 1. Nevertheless, notwithstanding the presence of such an additional elongated sinuous wire spring such prior art spring assemblies lack adequate support and stability for a person sitting on such an area.

The aforesaid disadvantages have been overcome to a significant degree by the present invention embodiments of which may be seen in the illustrations in FIGS. 3 to 10.

Figure 3:
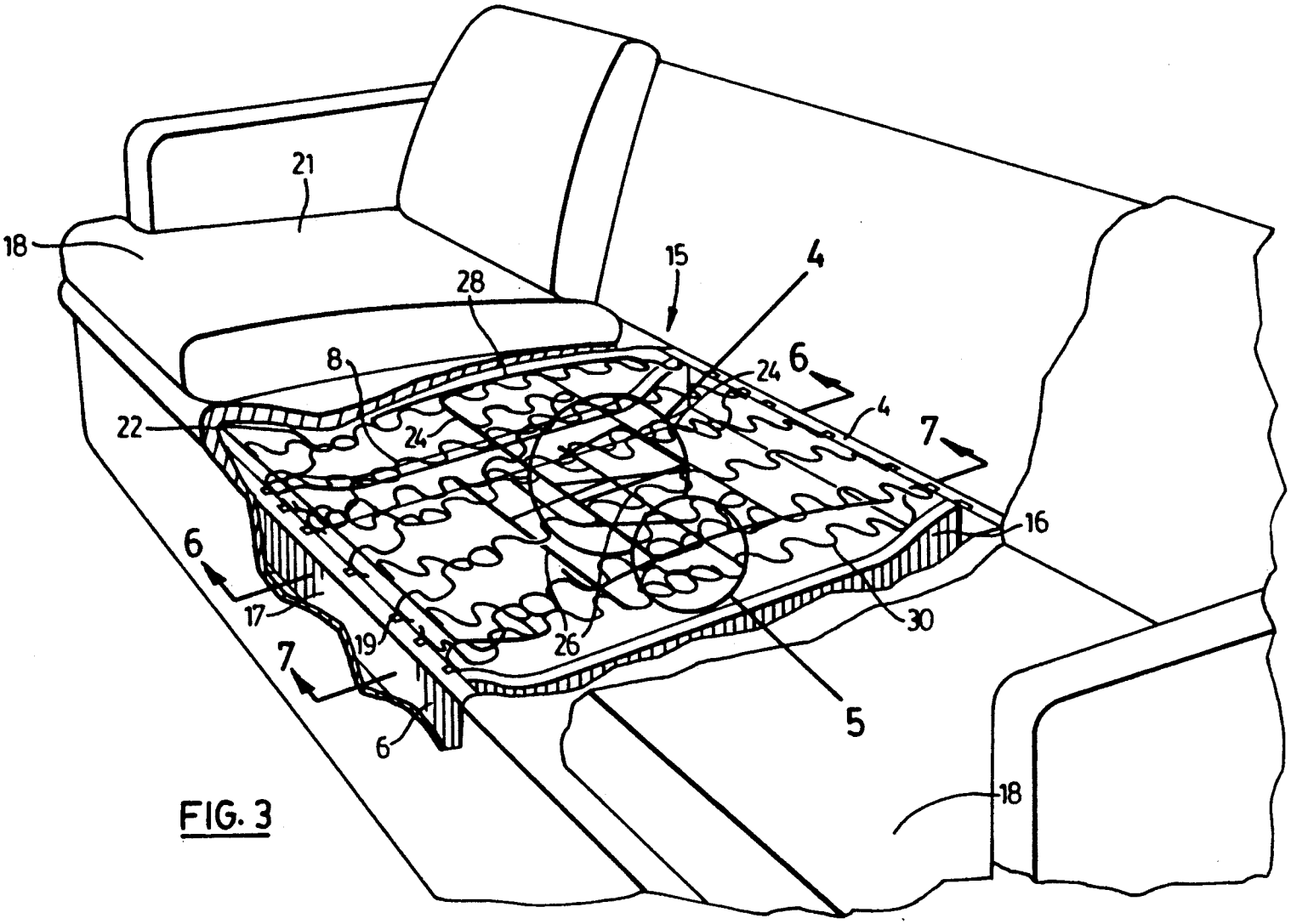
FIG. 3 is a top perspective view of a piece of upholstered furniture wherein one seating area has been cut away to permit the viewing of the orientation of the spring assembly of the instant invention.

FIG. 3 generally shows a piece of upholstered furniture such as a sofa having three separate seating areas or seating portions 18. The cushion and decking of the sofa in FIG. 3 is partially cut away over the middle seating area so as to illustrate one embodiment of the spring assembly of the present invention. Referring to FIG. 3 it may be noted that one spring assembly is generally shown as 15, and there would be three such spring assemblies adjacent each other in the case of a sofa, one spring assembly under each of the three seating areas 18.

The spring assembly 15 is comprised of a back rail 4 and a front rail 6. Joining the back and front rails may be a couple of seat stretcher members 16 (only one shown in FIG. 3) so as to comprise a generally rectangular frame 17 on which the spring assembly 15 is supported. The back rail, front rail and seat stretchers are typically made of wood, but can be made of any other suitable material.

Figure 7:
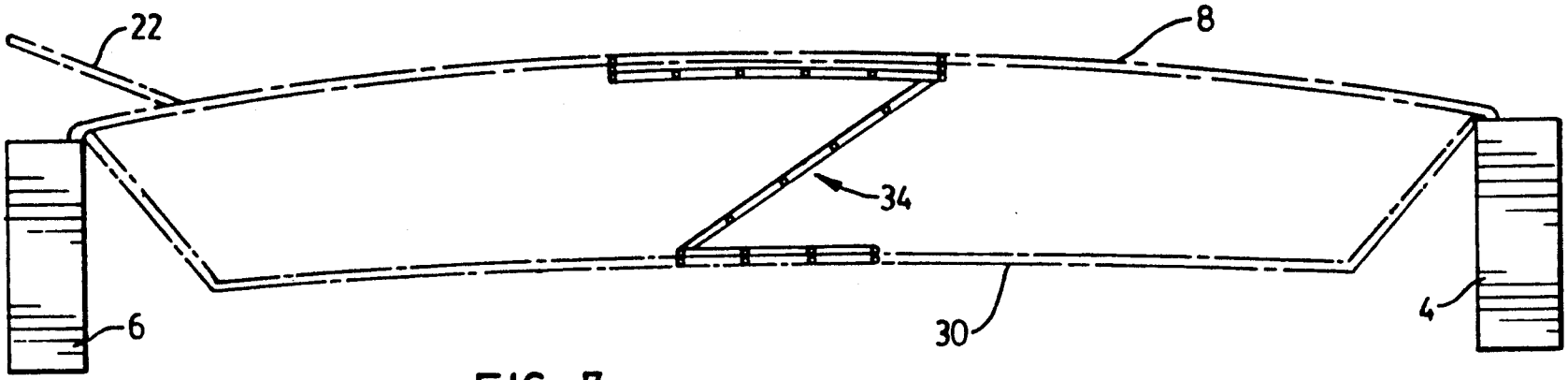
FIG. 7 is a cross-sectional view taken along line $7^1$ of FIG. 3.
Figure 6:
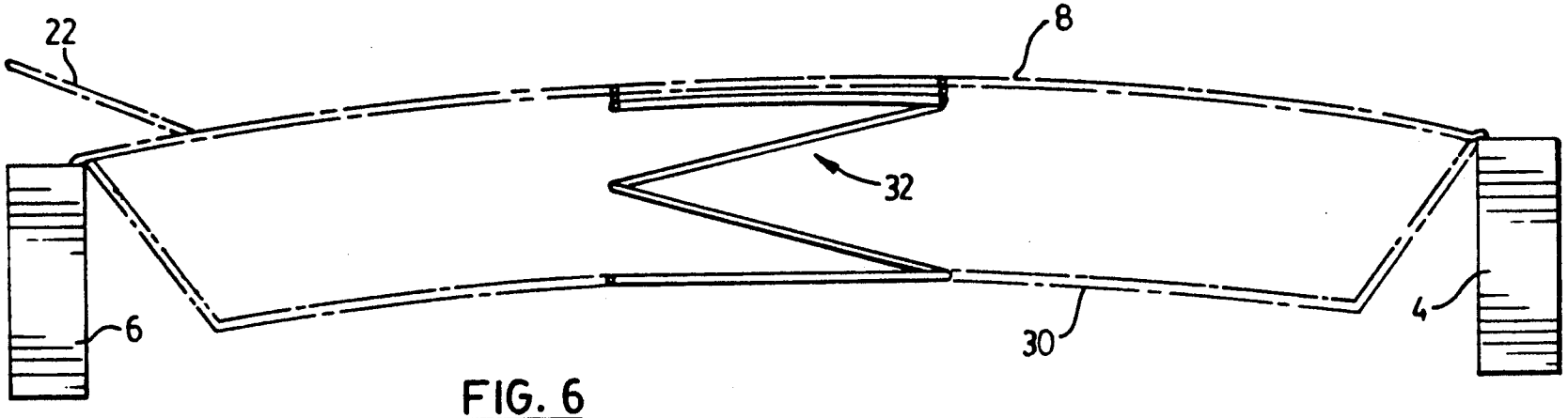
FIG. 6 is a cross-sectional view taken along line $6^1$ of FIG. 3.
Figure 8:
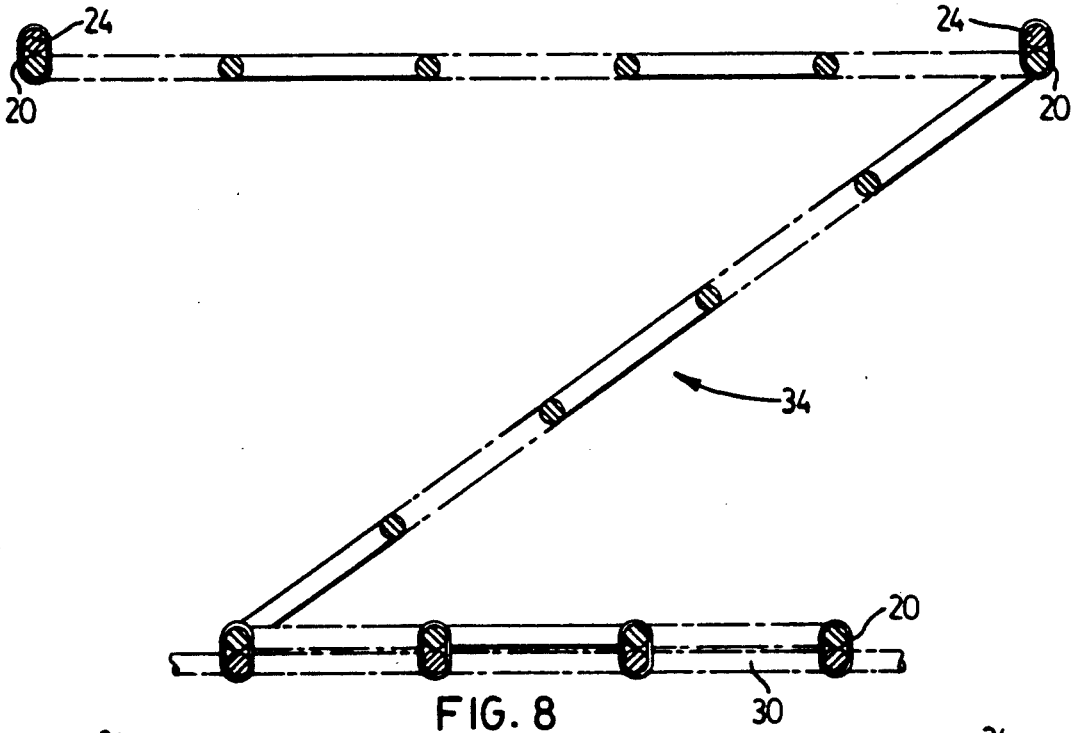
FIG. 8 is an enlargement of the Z-shaped sinuous wire spring portion of FIG. 7.
Figure 9:
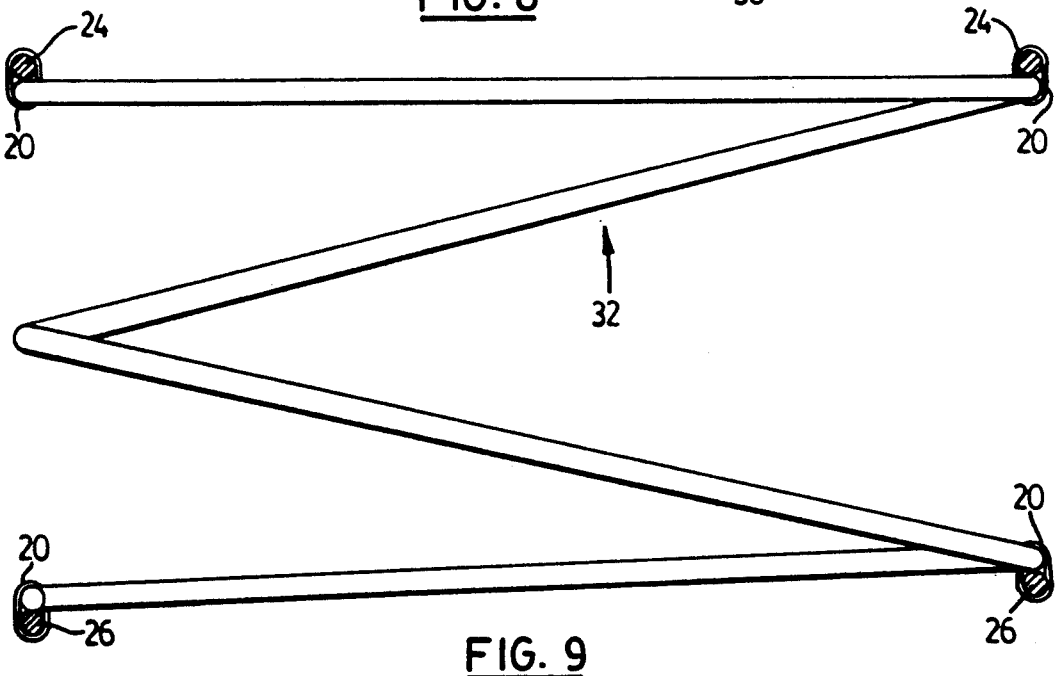
FIG. 9 is an enlargement of the quad coil portion of FIG. 6.
Figure 10:
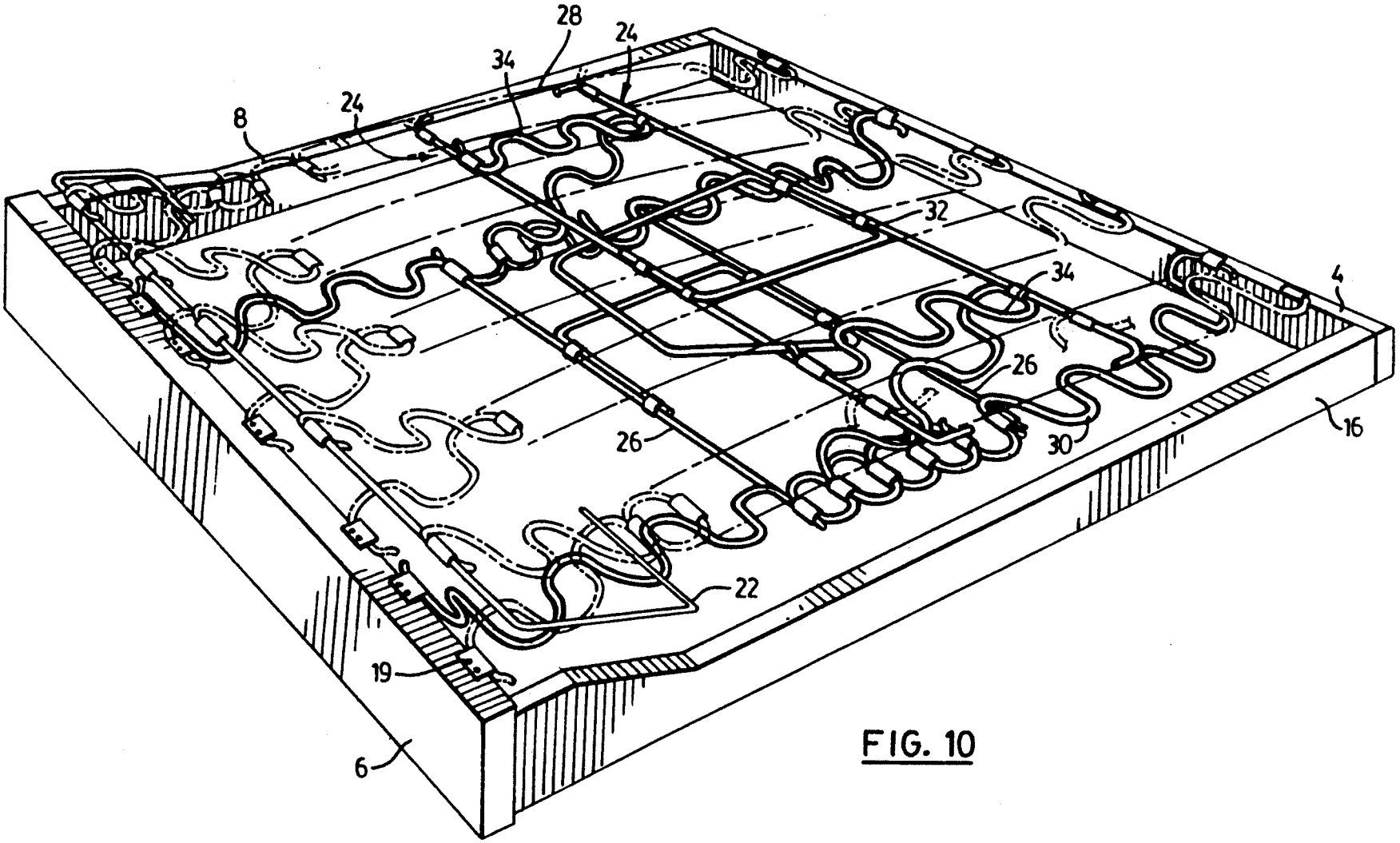
FIG. 10 is an enlarged perspective view of the spring assembly illustrated in FIG. 3.

Elongated sinuous wire springs 8 are periodically spaced along the length of frame 17 and are attached thereto by means of crimped sleeves or wire clips well-known to those skilled in this art (as for example at 19). Elongated sinuous wire springs 8 are all of a uniform shape, having been heat tempered, and rise above the level of frame 17 as noted in FIGS. 6 or 7, so as to evenly support a cushion 21 when placed thereon. Elongated sinuous wire springs 8 are interconnected with each other by a pair of upper wire stringers 24 so as to stabilize the lateral movement of elongated sinuous wire springs 8 upon a load being exerted on the spring assembly 15. A wire stringer 28 runs along the outside edge of each of the outer most elongated sinuous wires 8 so as to provide a straight edge and offer a stabilizing effect by preventing the twisting of these outer most elongated sinuous wire springs 8. Spring assembly 15 also includes a couple of elongated sinuous wire springs 30 which sit below the level of the top of frame member 17 and are generally shaped to be concave upwards or U-shaped as illustrated in FIG. 7. The purpose of the two elongated sinuous wire springs 30 is to provide a support means for each of the two Z-shaped sinuous springs 34 shown in cross-section in FIG. 7, one of which is located within area $5^1$ of FIG. 3. Elongated sinuous wire springs 30 can be of varying shapes and dimensions so long as they are capable of fulfilling the aforesaid purpose. There is one elongated sinuous wire spring 30 present to support each Z-shaped sinuous spring 34 in the spring assembly of the present invention. Elongated sinuous wires 30 are connected to each other by means of a pair of lower stringers 26 which are attached to elongated sinuous wires 30 by crimped sleeves or wire clips 20 or the like.

Figure 5:
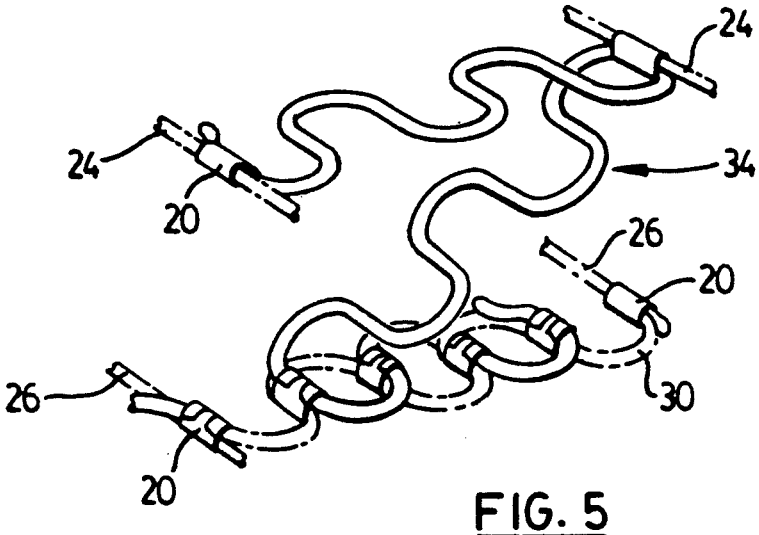
FIG. 5 is a perspective view of an enlarged Z-shaped sinuous spring located generally within the circled area 5' of FIG. 3.
Figure 4:
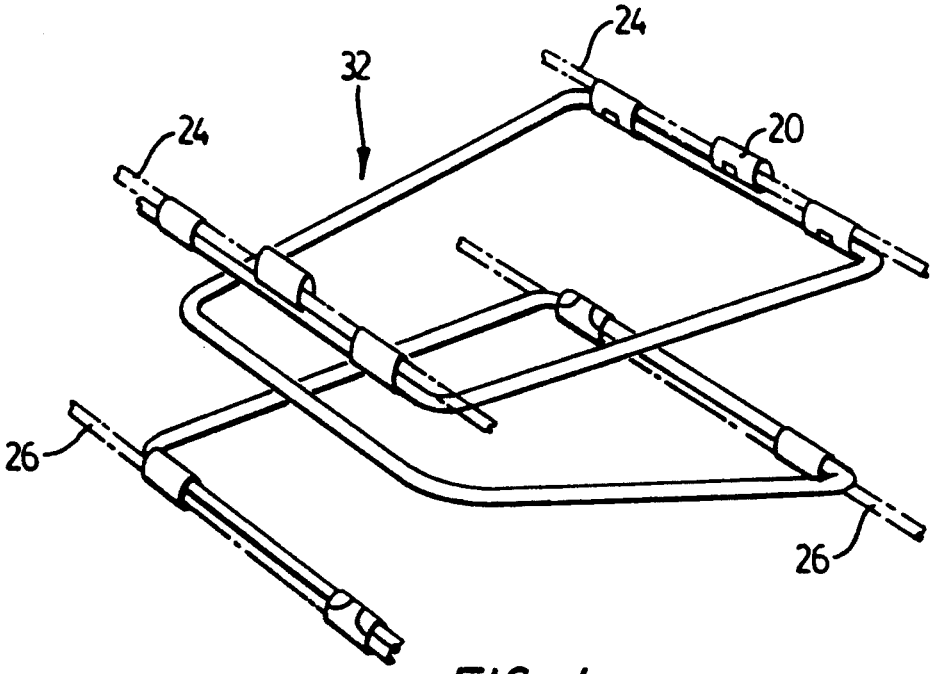
FIG. 4 is a perspective view of an enlarged quad coil located generally within the circled area 4' of FIG. 3.

The positioning of the lower and upper pairs of stringers 24 and 26 may also be seen in FIGS. 4 and 5.

Referring to FIG. 5, the manner in which the Z-shaped sinuous spring 34 is attached to the upper stringers 24 and the elongated sinuous wire springs 30 may be more readily discerned. The manner in which lower stringers 26 are attached (i.e., by clips 20) to elongated sinuous wire springs 30 may also be readily noted from FIG. 5. Lastly, FIG. 5 shows the attachment by the use of crimped sleeves or wire clips 20 of the Z-shaped sinuous spring 34 to an elongated sinuous wire spring 30.

Shown in FIG. 3 is a wire lip 22 which is not essential to the functioning of the spring assembly of the present invention, but is merely illustrated as being applicable thereto for the purpose of having a spring assembly with a soft edge construction. A spring assembly without the wire lip 22 is known to those skilled in the art as a hard edge construction spring assembly.

Referring to circled area $4^1$ in FIG. 3, there is generally indicated a rectangular or quad coil more readily discernable as identified by 32 in FIG. 4. Referring to FIG. 4, it will be noted that the upper portion of quad coil 32 is attached by clips 20 to upper stringers 24 and the lower portion of quad coil 32 is attached by similar means to lower stringers 26. Quad coil 32 is capable of functioning as a spring so as to offer a cushioning capacity.

Referring to FIG. 3, it will be noted that quad coil 32 is centrally located within the spring assembly 15, so as to provide the requisite amount of support in the centre of the seating area. Hence, the quad coil 32 due to its configuration provides an additional spring effect which is generally independent from the spring effect available from elongated sinuous wire springs 8, Z-shaped spring 34 or elongated sinuous wire springs 30. The quad coil 32 will also serve to provide extra support and therefore help avoid sagging in the central area of the spring assembly 15 which may otherwise occur over long term use of the upholstered furniture.

Referring to FIG. 3, it will be noted that the spring assembly 15 includes two Z-shaped sinuous springs 34 adjacent the lateral ends of the spring assembly. As may be more clearly visible in FIGS. 5 and 8, each sinuous spring 34 is Z-shaped in cross-section (see also FIG. 7) which configuration provides both support and is capable of acting as a spring. The same characteristics may be achieved by the use of springs having other suitable shapes such as for example a V-shaped sinuous spring in which case it would be attached slightly differently to elongated sinuous wire 30 (in particular there would be no overlapping of the bottom of the spring with elongated sinuous spring wire 30). The purpose of Z-shaped sinuous spring 34 is to provide firmer support and to stabilize the positioning of a person sitting thereon. Z-shaped sinuous spring 34 may offer the same or a different amount of resilience or spring effect as compared to that offered by quad coil 32. As a result of the location of the Z-shaped sinuous springs 34 within the spring assembly 15, they serve to prevent lateral shifting of a load applied to the centre of the spring assembly. The Z-shaped sinuous springs 34 tend to hug the outer thighs of a person sitting between these springs so as to provide a "bucket" seat arrangement and effect. In the case of a spring assembly 15 located adjacent an arm rest of a piece of upholstered furniture, a Z-shaped sinuous spring 34 located within the spring assembly immediately adjacent to the arm rest will serve to prevent or at least substantially diminish the tendency of a person sitting thereon from leaning or tilting towards the arm rest. Similarly, the Z-shaped sinuous springs 34 illustrated in the spring assembly 15 in FIG. 3, which particular spring assembly is under the middle of the three seating areas 18, will assist in balancing and stabilizing the weight of a person sitting in the middle seat portion notwithstanding a person of a heavier weight sitting on either one of the adjacent seat areas 18.

The stringers 24 and 26 (alternatively referred to as cross-tie wires by those skilled in the art) serve several functions. They provide a stabilizing effect by preventing the elongated sinuous wire springs 8 and 30 from moving laterally or twisting when a load is applied. These stringers also provide a mounting means or support means for the quad coil 32 and alternatively for the Z-shaped sinuous spring 34 (this alternative embodiment is not shown but it will be readily obvious to those skilled in the art). Lastly the stringers 24 and 26 permit the various component parts of the spring assembly to be interconnected while allowing at the same time the quad coil 32 and Z-shaped sinuous spring 34 of spring assembly 15 to offer generally independent and localized spring effect and support. The stringer wires 24 and 26 are usually twelve gauge but can vary depending on the design and desired capacity of the upholstered furniture. By way of example, the quad coil may be nine gauge and the Z-shaped sinuous spring may be eight gauge wire, but again these gauges may vary depending on the design and desired capacity of the spring assembly wherein they are employed.

In the present invention, the aforesaid component parts function to provide a spring assembly which offers more controlled and stabilized seating. Among other things, the quad coil offers extra support and spring generally to the central portion of each seating area, while the Z-shaped sinuous springs offer more localized and defined support and spring effect laterally to stabilize a person sitting between the Z-shaped sinuous springs. The quad coil, Z-shaped sinuous spring and lower elongated sinuous wire springs 30 when part of each spring assembly in a piece of upholstered furniture having multiple seating areas results in a unique and improved spring system wherein loads applied in one seating area will not cause leaning, tilting or otherwise disturb a person sitting on an adjacent seating area.

The design and configuration of the Z-shaped sinuous springs and the quad coil as well as their positioning within the spring assembly diminish the amount of softening of the spring assembly occurring with years of usage. The design, dimensions and configuration of these springs offer a better spring effect when compared with the elongated sinuous wire springs used in the prior art spring systems.

An important aspect of the present invention is the configuration of each spring employed in the spring assembly and the relative arrangement of the different types of springs in the assembly. The configuration of the springs and their relative arrangement provides a surprising advantage as follows. When a person sits on a chair having the spring assembly shown generally in FIG. 3, the following events occur in sequence. Firstly, the quad coil 32 is depressed. Secondly, the weight of the person impacts to depress almost simultaneously the upper elongated sinuous wire springs 8 and the Z-shaped sinuous springs 34. Thirdly, the lower elongated sinuous wire springs 30 are depressed. In the aforesaid sequence the quad coil 32 is depressed and physically moves the most, the Z-shaped sinuous spring 34 and upper elongated sinuous wire springs 8 are depressed and move a lesser amount, and the lower elongated sinuous wire springs 30 are depressed and move the least amount. Because the different springs are each sequentially engaged (upon a person sitting on the spring assembly) in order of increasing ability to cushion the applied weight or put another way in order of increasing firmness) the spring assembly of the present invention will not bottom out, as often happens with prior art spring assemblies.

The different springs utilized in the spring assembly of the present invention provide different levels of firmness which by their arrangement are sequentially engaged when a person's weight is applied thereto. The inventor has recognized that different levels of firmness can sequentially absorb and hence diminish the effect of the application of a heavy weight, thereby providing for a much improved cushioning effect without the spring system bottoming out. Accordingly, although some specific embodiments of the invention are described herein, it will be readily apparent to those skilled in the art that in one aspect of the present invention the shape, configuration and number of the same or different types of springs are not critical but may vary as long as there are several different springs (at least three) of varying capacity to absorb or cushion and they are arranged relative to each other in a manner which permits their sequential engagement upon a person applying his or her weight to the spring assembly containing such springs. What is essential is that there be different levels of cushioning capacity which may be sequentially engaged.

The quad coil and Z-shaped sinuous spring combination is a particularly advantageous embodiment since the shaping and configuration of these springs complement each other as may be noted by their basic "Z" shape in cross-section.

The aforesaid is by way of example only and alternate embodiments will be readily apparent to those skilled in this particular art. For example, in one aspect of the invention it may be possible to have two or more quad coils placed between the two Z-shaped sinuous springs (and interconnected by stringers 24 and 26). Such an alternate embodiment will provide many of the advantages of the instant invention.

The embodiments of the invention in which an exclusive property or privilege is claimed are defined as follows.

1. A spring assembly for the seat portion of upholstered furniture, said assembly having at least one spring sub-assembly comprising:

(a) a frame having a front and back rails, and (b) side rails; and a series of interconnected springs substantially independently supported within said frame, said series of interconnected springs comprising at least three different types of springs including a plurality of upper elongated sinuous wire springs arranged generally parallel to one another and transversely bridging in a uniform manner the front and back rails, quad-shaped spring means located centrally within said spring assembly, and Z-shaped spring means located centrally between said front and back rails on each side of said quad-shaped spring means between said quad-shaped spring means and said side rails, each of said spring type being capable of exerting a different level of firmness and each being sequentially engaged in order of increasing firmness in response to the application of a person's weight and to provide local support for a user sitting on said spring assembly between said Z-shaped spring means while substantially isolating said user from users sitting in any adjacent sub-assemblies comprising said spring assembly.

2. A spring assembly according to claim 1 comprising at least two identical spring sub-assemblies positioned adjacent each other so as to have one side rail in common.

3. A spring assembly for the seat portion of upholstered furniture, said assembly having at least one spring sub-assembly comprising:

(a) a generally rectangular frame including a back rail, two side rails and a front rail;

(b) a plurality of first, upper elongated sinuous wire springs arranged generally parallel to one another and transversely bridging in a uniform manner the back rail and the front rail at a height above the height of the rails so as to provide a spring effect when a downward pressure is applied thereto;

(c) quad-shaped spring means located centrally within the spring assembly and providing general support in the central area of the spring assembly;

(d) Z-shaped spring means located centrally between said back and front rails on each side of said quad-shaped spring means between said quad-shaped spring means and said side rails for providing local support in said spring sub-assembly between said quad-shaped spring means and each side rail;

(e) means for supporting said Z-shaped spring means within the spring sub-assembly; and (f) upper stabilizing means interconnecting each of said plurality of first, upper elongated sinuous wire springs with one another and with said quad-shaped and said Z-shaped spring means, and lower stabilizing means supporting said quad-shaped spring means and interconnecting said quad-shaped spring means with said means for supporting said Z-shaped spring means.

4. The spring assembly of claim 3 wherein said Z-shaped spring means comprises two Z-shaped sinuous springs and said means for supporting said Z-shaped sinuous spring comprises second, lower elongated sinuous springs extending from the back rail to the front rail at a height below the height of said plurality of first, upper elongated sinuous springs, and wherein said quad-shaped spring means includes a base and said lower stabilizing means comprises stringer members extending from the base of said quad-shaped spring to said second, lower elongated sinuous springs, said upper stabilizing means comprising stringer members interconnecting said plurality of first, upper elongated sinuous springs with said quad-shaped spring and said Z-shaped sinuous springs, said stringer members being attached to said quad-shaped spring and to said Z-shaped sinuous springs and to said first upper and said second lower elongated sinuous springs by means of crimped sleeves.

5. A spring assembly according to claim 3 comprising at least two identical spring sub-assemblies positioned adjacent each other so as to have one side rail in common.

6. A spring assembly according to claim 4 comprising at least two identical spring sub-assemblies positioned adjacent each other so as to have one side rail in common.

* * * * *